US010150331B2

(12) United States Patent
Martin

(10) Patent No.: US 10,150,331 B2
(45) Date of Patent: Dec. 11, 2018

(54) METHOD OF MANUFACTURE FOR DECORATIVE WORKS OF ART

(71) Applicant: Sherry Lou Martin, Racine, WI (US)

(72) Inventor: Sherry Lou Martin, Racine, WI (US)

(73) Assignee: Sherry Lou LLC, Racine, WI (US)

( * ) Notice: Subject to any disclaimer, the term of this patent is extended or adjusted under 35 U.S.C. 154(b) by 255 days.

(21) Appl. No.: 14/270,502

(22) Filed: May 6, 2014

(65) Prior Publication Data

US 2014/0326388 A1 Nov. 6, 2014

Related U.S. Application Data

(60) Provisional application No. 61/819,810, filed on May 6, 2013.

(51) Int. Cl.
*B44C 1/28* (2006.01)

(52) U.S. Cl.
CPC ..... *B44C 1/28* (2013.01); *Y10T 156/1052* (2015.01)

(58) Field of Classification Search
CPC ..... B32B 17/10247; B44C 1/28
USPC ..... 156/63, 250
See application file for complete search history.

(56) References Cited

U.S. PATENT DOCUMENTS

| | | | | |
|---|---|---|---|---|
| 2,887,806 | A * | 5/1959 | Hassett | 428/46 |
| 3,516,893 | A * | 6/1970 | Gerard | 156/277 |
| 2006/0207715 | A1* | 9/2006 | Barban | 156/250 |
| 2008/0276927 | A1* | 11/2008 | Martin | 126/547 |
| 2009/0197087 | A1* | 8/2009 | Waldvogel | 428/410 |

* cited by examiner

*Primary Examiner* — Philip C Tucker
*Assistant Examiner* — John Blades
(74) *Attorney, Agent, or Firm* — Jason Munger McKinley & Kirby Ltd.

(57) ABSTRACT

A method of making a decorative shattered-glass screen or other work of art, including providing a planar main member, applying a two-dimensional graphical decorative work to the main member, applying a substantially clear viscous liquid adhesive over the decorative work of art, applying a shatterable clear glass pane onto the adhesive layer while still in liquid form, striking the pane, preferably on its edge, to shatter the pane into a multiplicity of shattered glass pieces and by such shattering causing the shattered glass pieces to spread from one another, and solidifying the adhesive layer to form a shattered-glass mosaic.

10 Claims, 8 Drawing Sheets

METHOD OF MANUFACTURE FOR DECORATIVE WORKS OF ART

RELATED APPLICATION

This application claims the benefit of U.S. Provisional Application No. 61/819,810, filed on May 6, 2013, the contents of which is incorporated by reference herein in its entirety.

FIELD OF THE INVENTION

This invention relates to decorative works of art such as for display, for screens (e.g., for fireplace screens), or for other purposes.

BACKGROUND OF THE INVENTION

This invention is an improvement on the manufacturing methods disclosed and claimed in U.S. Pat. No. 8,342,166, which is owned by the inventor herein and all of which is incorporated herein by reference. The "screens" referred to in such patent and below are given by way of example; the decorative works of art in such patent and made by the improved method of this invention can be used in multiple ways and for multiple display purposes.

Wood-burning fireplaces within houses and other buildings are nearly as old as houses and buildings themselves and serve both functional and aesthetic purposes. With the rise of modern central heating systems, fireplaces have more and more become things that are primarily of aesthetic concern only. Indeed, many homes that include fireplaces typically make little use of them even in winter, despite the fact that they provide two types of warmth and comfort—physical warmth and comfort to those nearby and the psychological warmth and comfort associated with innumerable memories and stories of family gatherings.

But functional fireplaces also involve the attendant well-known problems of preventing heat loss up the chimney, particularly when the fireplace is not in use. And, since fireplaces in homes are often considered visual focal points for the rooms they serve, the matter of the appearance of a fireplace is often also a primary concern. Solving these fireplace-related problems and concerns are addressed by the product made using the improved manufacturing method of this invention.

Decorative screens are used for a wide variety of other purposes, such as to provide a degree of privacy or to cover interior or exterior openings in homes or other structures. Providing decorative screens of remarkable appearance often depends almost primarily, if not exclusively, on the artistic ability of the creating artist, and not primarily on the nature of the structure. This invention is also directed toward improved manufacture of decorative screens. The improved manufacturing method of this invention also has bearing on manufacture of special decorative tiles such as are used on walls in buildings.

Manufacture of the unique decorative works and fireplace screens as disclosed in the above-mentioned patent tends to be fairly time-consuming, particularly with respect to creation of the "mosaic" of a great number of shattered glass pieces. With this in mind, it is a primary objective of this invention to improved and accelerate the manufacturing process, and to do so without compromising the unique artistic appearance of the resulting products. Other objectives will be apparent from the descriptions which follow.

SUMMARY OF THE INVENTION

This invention is an improved method of manufacturing the unique decorative works of art disclosed in the aforementioned patent, whether such pieces are to be used for fireplace screens, other screening purposes, display art, or other things such as tiles.

The improved method includes: first providing a planar main member sized as intended for the work of art, the planar main member, of course, having front and back surfaces; applying a two-dimensional graphical decorative work to the front surface of the main member; then, with the planar member and applied decorative work preferably in a substantially horizontal orientation, applying a substantially clear viscous adhesive liquid layer directly onto and over the decorative work of art; then, while the adhesive layer is still in the form of a viscous liquid, applying a clear glass pane onto the adhesive layer; then striking the pane with a hammer or other striking implement sufficiently to shatter the pane into a multiplicity of shattered glass pieces, such striking causing not only shattering but also a moving apart of the shattered glass pieces with respect to one another; and finally allowing the liquid adhesive to solidify with the shattered glass pieces in place thereon.

After striking the pane to shatter it into a large number of shattered glass pieces, the spacing between the shattered glass pieces may be adjusted as desired by manual movement of pieces before the liquid adhesive solidifies.

It is preferred that the striking of the glass pane be on the edge of the pane, since this has been found to be a particularly useful and effective way to shatter the pane. In fact, it is preferred that a single striking of the pane be done at one edge position selected for the most effective shattering. In some cases, plural strikes may be used.

This invention is based in part on the discovery that shattering the glass pane by striking it on an edge thereof, as opposed to on the face thereof, is very effective not only in providing sufficient shattering but also in instantly causing a spreading of the shattered glass pieces such that a desirable mosaic look is achieved—even without necessarily doing piece-by-piece manual adjustment of the locations of the shattered glass pieces.

In highly preferred embodiments, the glass pane applied onto the layer of viscous (non-solidified) liquid adhesive is dimensioned such that before the striking step there is a margin therearound not covered by the glass pane. Then, as the striking step is carried out, the shattering of the glass, caused by the striking alone, causes sufficient moving of the shattered glass pieces apart from one another to substantially populate the previously-uncovered margin with shattered glass pieces—giving a highly desirable appearance to the final product.

After the adhesive layer has solidified to permanently establish the fixed positions of the pieces of shattered glass, grout is applied between the glass pieces to finalize the mosaic appearance and to further secure the shattered glass pieces in their places.

Preferred embodiments of the method of this invention, particularly when the resulting product is to be used as a fireplace screen, include the further step of applying a layer of insulating material at the back surface of the planar main member. This allows the product, when used as a fireplace screen, to not only block or retard air flow up the chimney, but also to minimize heat losses through the screen.

Preferred embodiments of the method of this invention may include, or also include, the further step of applying a gasket strip at the back surface of the planar main member along the edges thereof. Such a gasket strip is configured to facilitate surface-conforming contact of the decorative work of art about an opening through which energy losses are otherwise typical. For example, if a fireplace being covered is a brick fireplace, the gasket strip can conform to the irregular surfaces of the brick to minimize air flow around the screen.

Certain preferred embodiments of this invention include applying a frame to the front of the main member about the edges thereof either before or after the step of applying the two-dimensional graphical decorative work to the main member and prior to the step of applying the clear viscous liquid adhesive layer. This helps finish and improve the presentation of the decorative mosaic-like appearance portions of the screen or art work. When an insulation layer is applied to the back of the product, the frame is preferably positioned and/or configured such that the back surface of the planar main member is recessed with respect to the frame, and the insulating material is positioned within the recess.

Preferred embodiments of the product of this invention, when configured and used, e.g., as fireplace screens, have a support member along the lower edge of the main member which may be part of or attached to the frame and be configured to allow the decorative screen to stand on the floor or other horizontal surface which is immediately in front of a fireplace opening.

The screens made by the method of this invention have a unique decorative appearance. Furthermore, as pointed out in the above-noted patent, some preferred forms of the subject fireplace screens may have a transparent main layer; and, when in place while the fireplace is being used, this creates further interesting and unique visual effects. In the latter uses (and others), the inventive fireplace screen may either be right against the fireplace opening or just back from such opening.

The term "fireplace screen" as used herein refers to a generally planar vertical sheet-like structure that is placed over a fireplace opening, rather than to a porous wire (or similar) structure the purpose of which is to allow air flow through it. No air flow is contemplated.

As pointed out in the above-noted patent, the term "design-enhancing mosaic" as used herein does not imply that the design is the mosaic itself, as is often the case with a typical mosaic made with typically opaque stones or other pieces of widely varying colors. The design-enhancing mosaic forming part of this invention is called a "mosaic" because of the preferred rather-random nature of the glass pieces themselves, including as shattered in place on the clear viscous liquid.

DETAILED DESCRIPTION OF PREFERRED EMBODIMENTS

Figure 2:
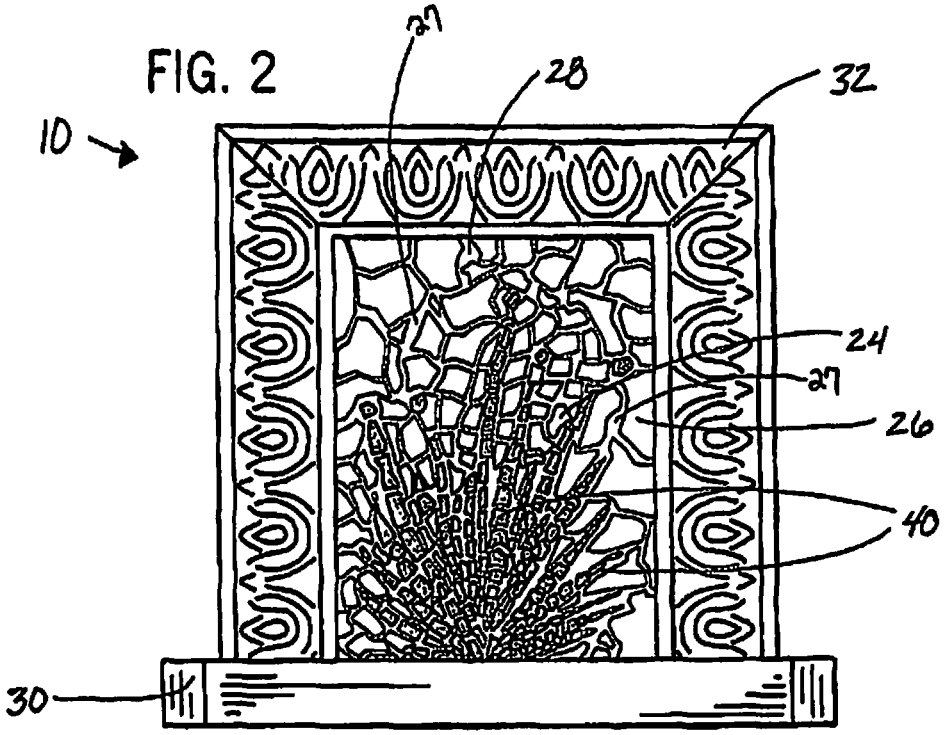
FIG. 2 is a front view of the device of FIG. 1 with flame design, lower edge support member and frame.
Figure 3:
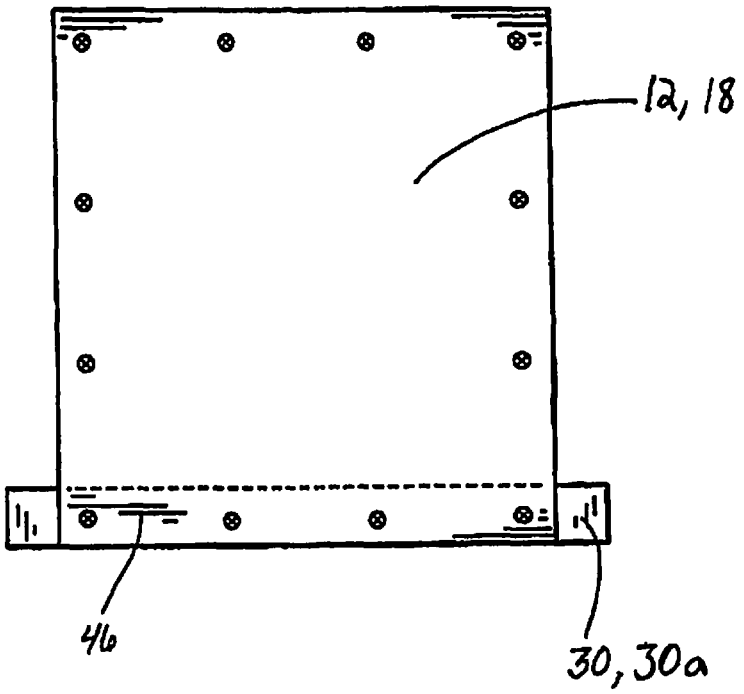
FIG. 3 is a back view of the device of FIG. 1 without the foam board.
Figure 4:
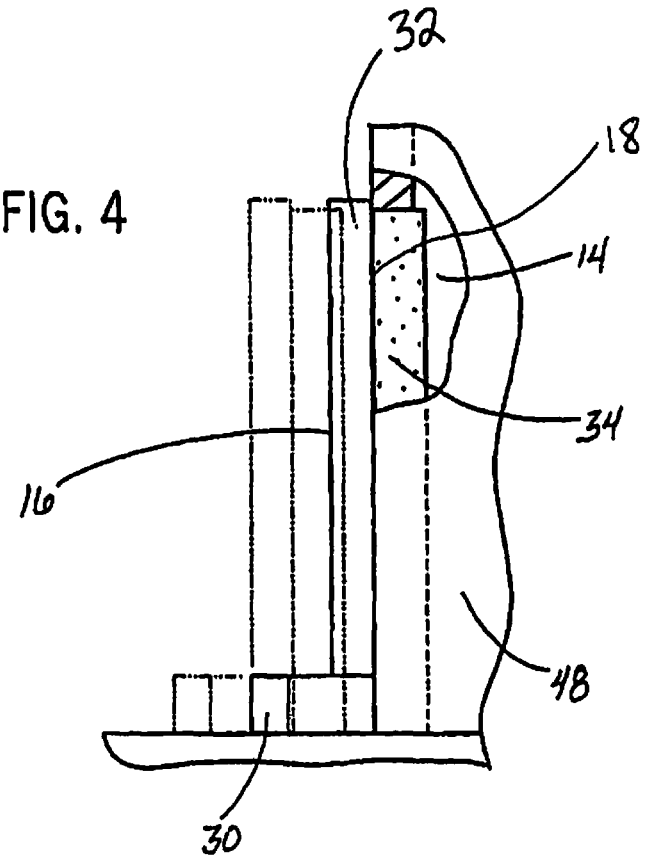
FIG. 4 is a schematic side view of the device of FIG. 1 positioned in a fireplace opening, with phantom lines indicating a pre-positioning position and full lines a post-positioning position.

FIGS. 1-7 illustrate a decorative fireplace screen 10 for draft sealing of fireplace 48 having a fireplace opening 14. As seen in FIGS. 1-7 decorative fireplace screen 10 includes planar main member 12 sized to substantially cover fireplace opening 14. FIG. 4 illustrates fireplace screen being slid into fireplace opening 14 (represented by phantom lines) and thereafter substantially covering fireplace opening 14. Main member 12 has front and back surfaces 16, 18 as shown in the figures. Main member 12 may be a particle board or may be of wood, plastic or metal or even of glass or a transparent polymeric material.

Figure 6:
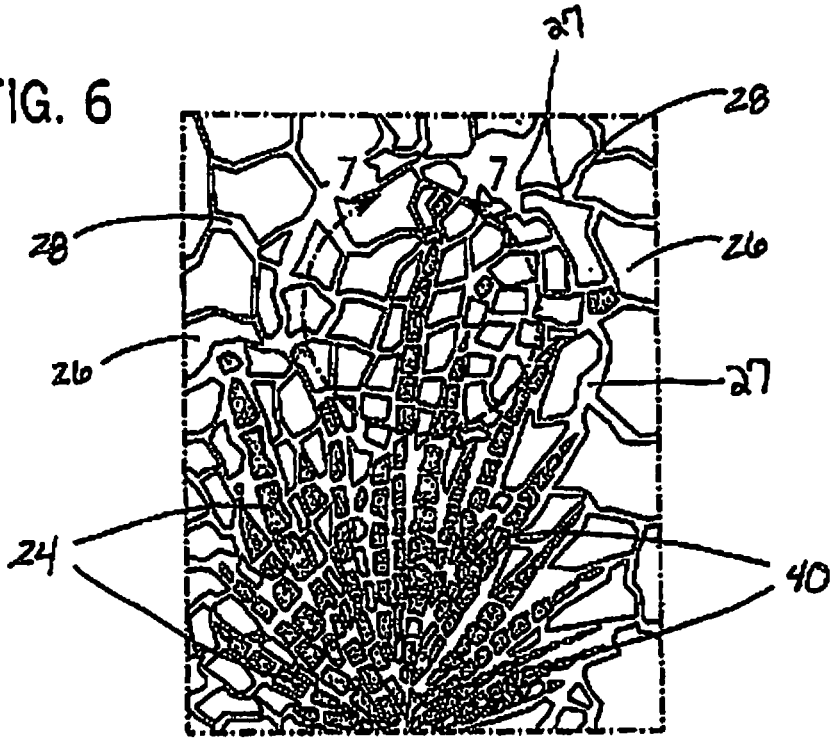
FIG. 6 is a fragmentary front view of the device of FIG. 1, illustrating the artistic mosaic that is used.

Decorative design 20 is applied to front surface 16 of main member 12. A substantially clear adhesive layer 22 is applied onto decorative design 20 and a design-enhancing mosaic 24 of shattered glass pieces 26 is adhered to adhesive layer 22 and substantially covers decorative design 20. As seen in FIG. 6 shattered glass pieces 26 are adhered to decorative design 20 to create mosaic 24 and grout 28 is applied between shattered glass pieces 26 which secures them in place.

Figure 7:
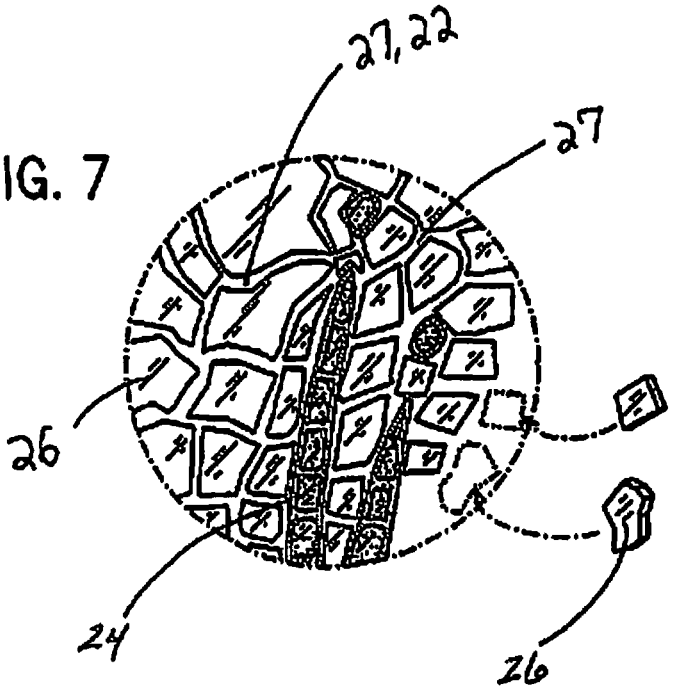
FIG. 7 is a magnified portion of the fireplace screen as indicated in adjacent FIG. 6.

As seen in FIG. 7 the shattered glass pieces 26 are applied and secured to decorative design 20 through the use of clear adhesive layer 22. It is preferred that clear adhesive layer 22 be a clear silicone adhesive.

FIGS. 1-5 illustrate that decorative fireplace screen 10 has support member 30 along the lower edge 46 of main member 12 to support main member 12 of fireplace screen 10 in its placement at the fireplace opening 14. Frame 32 is also applied to front surface 16 of main member 12 about the edges 44 of main member 12 as seen in FIGS. 1, 2, 8*a*-*e* and 9-10.

Figure 1:
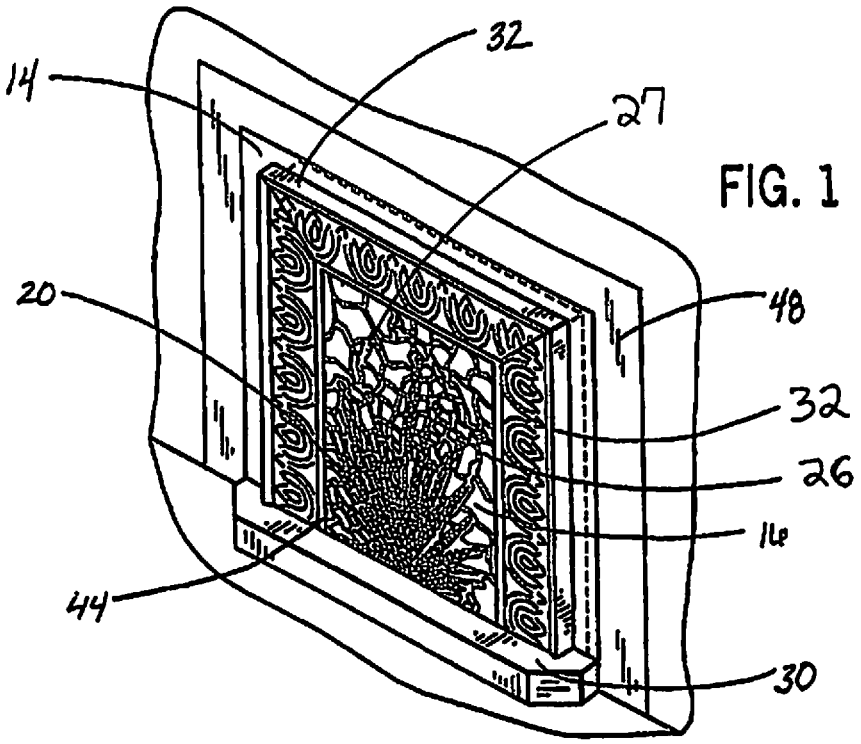
FIG. 1 is a front perspective view of the device positioned in front of a fireplace opening.
Figure 5:
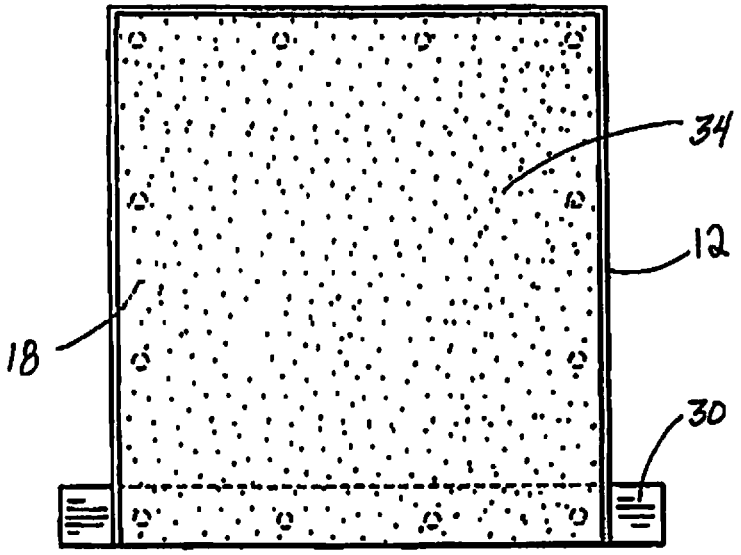
FIG. 5 is a back view of the device of FIG. 1 illustrating the foam board.

FIG. 1 illustrates decorative fireplace screen 10 positioned in front of a fireplace 48 and specifically in front of fireplace opening 14. FIG. 2 illustrates decorative fireplace screen 10 not positioned in front of a fireplace opening 14. FIG. 3 shows the back surface 18 of main member 12 without foam board 34 attached to back surface 18. As illustrated in FIG. 5, foam board 34 is applied to back surface 18 of main member 12, thereby facilitating thermal insulating characteristics of the product when used to cover fireplace opening 14. Foam board 34 is generally a polystyrene foam board, or other insulating material. It is preferable that foam board 34 be a fire resistant insulation board.

The items used to manufacture the screens and artwork pieces of this invention include the following: fiberboard, wood, metal, plexiglass or glass for main member 12; wood, metal for frame molding members for frame 32 and for lower support member 30; a somewhat viscous liquid adhesive such as clear acrylic adhesive 22; a clear or colored shatterable transparent tempered glass pane 23 (see FIG. 8*c*), which may be, e.g., 0.125 inch thick; construction grout cement 28; 1¼-inch wood screws; 2½-inch wood screws; acrylic paint or oil paint and construction foam insulation board 34; and a gasket strip 29 (see FIGS. 9 and 10), preferably of the sort that can be affixed by adhesive to the back of the screens.

The manufacturing method of this invention is now described, including with additional detail, primarily with reference to FIGS. 8*a-e*, 9 and 10.

After the main planar member 12 is cut to the specific desired fireplace-opening 14 size or size of the intended other screen or artwork, it may be painted (or printed), typically uniformly with a background color (preferably black). If a transparent main member 12 is used, it is not painted; this will allow some light transmission through the finished product.

After the main member 12 has been made ready, an artistic design, such as the decorative flame design 40 shown in FIGS. 1-2, is applied to front surface 16 of main member 12. This may be done in a number of ways, reflecting the artistic creativity of the craftsman making the product—or even reflecting theme elements important to the ultimate buyer.

Next, frame 32, itself preferably decorative, is attached by construction glue and then screwed down with 1¼-inch wood screws every three inches or so around outer edge of back surface 18 of main member 12. This stage of manufacture is seen in FIG. 3. Then lower support member 30, which includes back surface 30a, is attached by gluing with construction glue and using 2½-inch wood screws every three inches or so for added support, making sure that lower support member 30 is centered with respect to lower edge 46 and frame32. This stage of manufacture is seen in FIG. 4. Lower support member 30, in addition to serving its purpose of supporting decorative fireplace screen 10 in its proper use position in front of a fireplace opening 14, also serves to complete the framing of decorative design 20. Attachment means other than screws can be used, as would be apparent to those skilled in the art who are made aware of this invention.

The order of these frame 32 and lower support 30 attachment steps with respect to each other, and even with respect to the painting on (or other application) of the artistic design, is not of importance to the method of this invention.

Figure 8A:
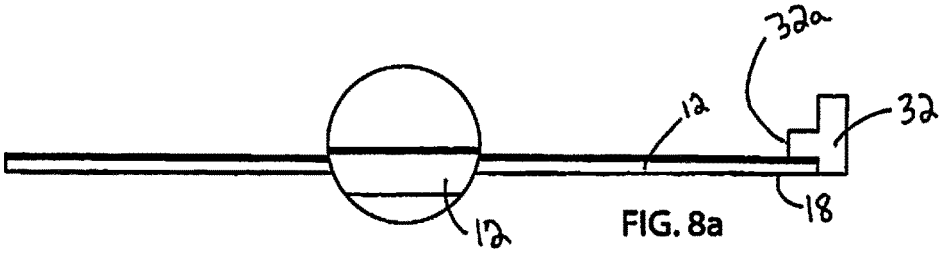
FIGS. 8*a*-8*e* are a sequence of schematic views illustrating the steps of the inventive method, such figures each having a magnified portion for purposes of clarity. Such schematic figures are fragmentary views of a somewhat revised embodiment of the device of this invention in which the frame has a recess receiving the main member.

FIG. 8*a* schematically illustrates the state of the work in progress before application of viscous liquid adhesive and the steps that create the shattered glass mosaic. The thick horizontal line in FIG. 8*a* stands for the combination of front surface 16 of main member 12 and decorative design 20 that has been applied thereto. (For convenience, in schematic FIGS. 8*b-e* such thick line is no longer used, but it is to be understood, of course, that decorative design 20 remains in place, even though covered by other layers.

Figure 8B:
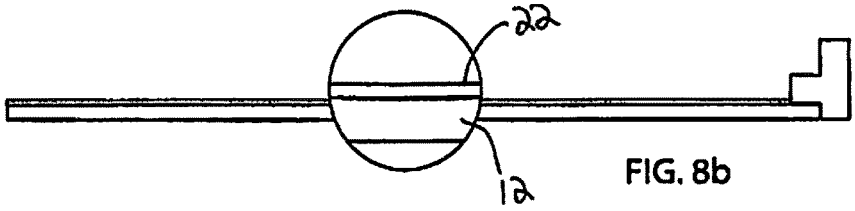

With main member 12 on a table or workbench in horizontal orientation with its front surface 16 up, a fairly substantial layer of clear acrylic adhesive 22 in viscous liquid form is applied over decorative design 20 in order to prepare to receive what will become the design-enhancing mosaic 24 of shattered glass pieces 26. FIG. 8*b* schematically illustrates the stage of viscous liquid adhesive being in place, ready for subsequent steps of the method.

Next, a tempered glass pane 23 is placed directly onto clear adhesive layer 22 in position such that glass pane 23 substantially covers front surface 16 with its applied decorative design 20, but with a little margin 16*a* thereabout, between the edge 23*a* of unshattered pane 23 and the inward surface 32*a* of frame 32, a margin which is not covered by glass pane 23. Uncovered margin 16*a* creates room for movement of shattered glass pieces 26 during the sudden shattering process, hereafter described, i.e., to accommodate the shattering and spreading effects described above. The pre-shattering application of glass plane 23 is illustrated schematically in FIG. 8*c*.

Figure 8C:
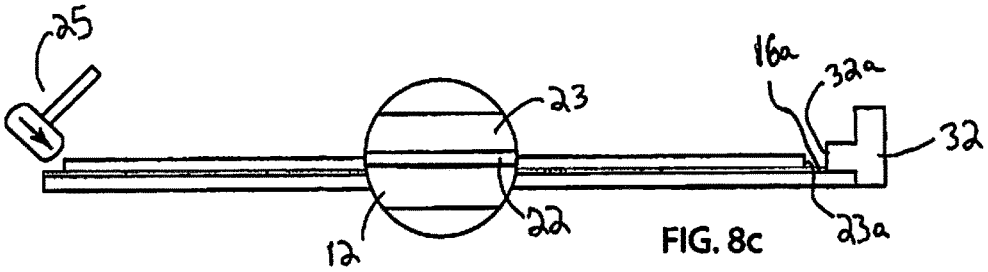

Next, while the clear adhesive still in its liquid form, a hammer 25 or other striking instrument is used to strike (e.g., tap) one portion of the edge of the glass pane 23, as illustrated schematically in FIG. 8*c*. This results in the shattering of substantially the entirety of the glasspane, and also in the creation of at least slight spaces 27 between the great number of shattered glass pieces 26, creating a mosaic-like arrangement. The edge striking illustrated schematically in FIG. 8*c* results in shattered glass pieces 26 substantially populating the previously-uncovered margin areas 16*a*. This step is illustrated schematically in FIG. 8*d*.

While not wanting to be limited by any theory, it is believed that this sudden shattering action in the presence of the liquid adhesive 22 is what results in the highly-controlled sudden spreading movement of the shattered glass pieces 26 with respect to one another that creates spaces 27 between shattered glass pieces 26 to form the attractive mosaic-like effect.

Figure 8D:
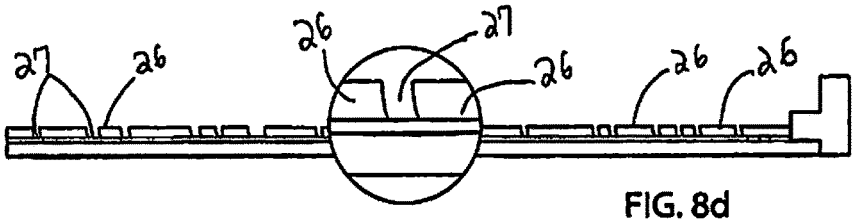
Figure 8E:
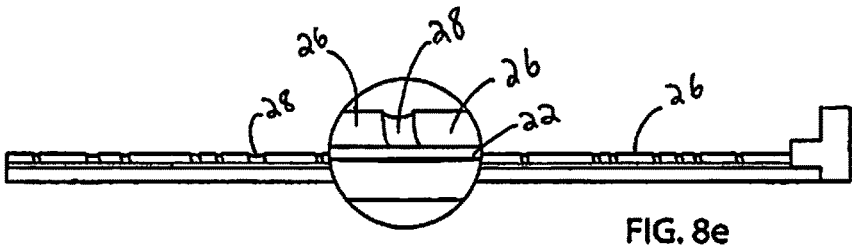

The extent to which shattering occurs depends on the force and location of the impact on the edge of the pane-and on the exact nature of the glass pane. If needed, plural impacts on the edge of the pane, each at a different location, will create the mosaic-like appearance which is desired, and which substantially replicates a mosaic of shattered glass pieces placed on the clear adhesive in one-by-one fashion. The entire exposed front surface 16 of main member 12 is covered, leaving small spaces 27 between the shattered glass pieces 26, as seen in FIG. 8*d*.

The glass shattering and shattered-piece movement caused by tapping the edge of the glass pane is typically fully sufficient for creating the desired mosaic-like appearance. However, it is of course possible for the operator to adjust individual pieces manually to achieve or enhance the desired mosaic-like appearance.

After the adhesive has solidified to hold shattered glass pieces 26 in position, grout 28 is then carefully applied to substantially fill in the gaps between shattered-glass pieces 26. This is illustrated schematically in FIG. 8*e*. The grouting is done in a manner such that the shattered glass pieces 26 themselves are not covered on their frontally-exposed surfaces, in order that decorative design 20 below such shattered glass 26 mosaic 24 may be seen. The structural combination of such shattered glass 26 mosaic 24 and the design elements therebeneath give a very unique appearance to the product.

The thickness of the glass pane used and the nature of the selected glass (preferably tempered glass) will determine the exact manner in which the improved manufacturing method of this invention is carried out. Details of the particular embodiment referred to in this document are not intended to be limiting. Whether or not a frame is used to surround the artwork, the exact nature of the liquid adhesive, and other aspects of the method may be varied. While a clear acrylic adhesive layer is preferred, a two-part clear resin adhesive may be used instead, and acceptable clear or substantially clear viscous liquid adhesives would be apparent to those skilled in the art who are familiar with this invention.

Figure 10:
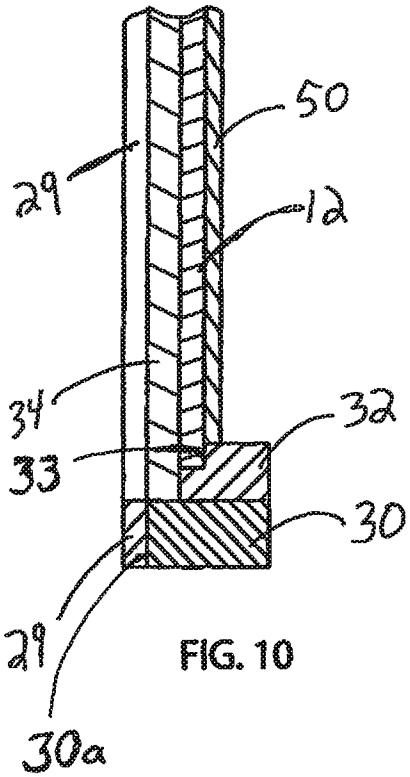
FIG. 10 is a schematic side sectional view taken along section 10-10 as indicated in FIG. 9, such view illustrating the relationships of some of the layers and parts assembled using the method of this invention.
Figure 9:
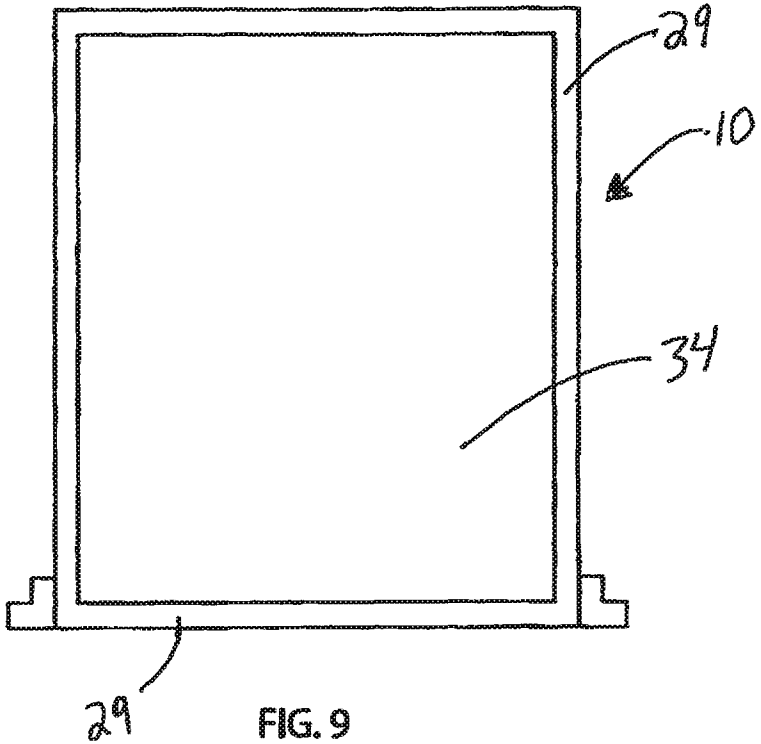
FIG. 9 is a schematic back elevation of a fireplace screen made using the method of this invention, such fireplace screen being yet another embodiment, but one which, like that shown in FIGS. 8*a*-*e*, includes a frame with a recess receiving the main member (see FIG. 10).

At some point in the manufacturing process, foam construction board 34 is attached to back surface 18 of main member 12, as seen in the FIG. 5 back view. Foam board 34 may be secured in place with construction adhesive (not shown). FIG. 9, which is a back elevation of a fireplace screen made in accordance with this invention, and the sectional view of FIG. 10 show insulating board 34, and also show gasket strip 29. Schematic FIG. 10 shows frame 32 being offset forwardly in its position on lower support member 30, thereby providing a recess to receive insulating board 34. FIG. 10 also shows frame 32 itself configured, as also seen in FIGS. 8*a*-8*e*, to have a recess 33 in which the layer which is main member 12 is located. FIG. 10 also shows that gasket strip 29 projects rearwardly such that its pliable qualities allow it to engage rough surfaces, such as brick, and facilitate the blockage of air movement past the edge of the screen. (In schematic FIG. 10, the layer marked by numeral 50 represents the combination of shattered glass pieces, solidified adhesive, grout and underlying two-dimensional graphical work, shown for convenience as a single layer with no detail as to such separate portions.)

While the principles of the invention have been shown and described in connection with specific embodiments, it is to be understood that such embodiments are by way of example and are not limiting.

LIST OF NUMBERS USED IN SERIAL NO. 14/270,502

10 decorative fireplace screen
12 main member
14 fireplace opening
16 front surface (of main member 12)
16*a* uncovered margin (about pane 23)
18 back surface (of main member 12)
20 decorative design
22 clear adhesive layer shatterable glass pane
23*a* edge of (unbroken pane 23)
24 mosaic
25 hammer
26 shattered glass pieces
27 spaces (between pieces)
28 grout
29 gasket strip
30 support member
32 frame
32*a* inward surface (of frame 32)
34 foam board
40 decorative flame design
42 transparent main member
44 edges (of main member 12)
46 lower edge (of main member 12)
48 fireplace
50 layer (consisting of pieces 26, solidified adhesive 22 and underlying decorative design 20)

The invention claimed is:

1. A method of making a decorative work of art, the method comprising:

providing a planar main member sized as intended for the work of art, the main member having front and back surfaces;

applying a frame to the front of the main member about the edges thereof;

applying a two-dimensional graphical decorative work to the front surface of the main member;

applying a substantially clear viscous adhesive liquid layer directly onto and over the decorative work of art, such liquid layer extending to the frame;

applying a shatterable clear glass pane onto the adhesive layer while the adhesive layer is still in the form of a viscous liquid, the pane having a perimeter edge sized and positioned to leave a margin between the frame and the perimeter edge;

striking the pane with a hammer or other striking implement sufficiently to shatter the pane into a multiplicity of shattered glass pieces while the adhesive layer is still in the form of a viscous liquid and cause not only shattering but also a spreading apart of the shattered glass pieces with respect to one another to cover the entire main member within the frame, including the margin, and achieve mosaic-like spacing of the glass pieces over the two-dimensional graphical decorative work;

thereafter allowing the liquid adhesive layer to solidify with the shattered glass pieces in place, the pieces bonded thereunder with respect to the decorative work, leaving unfilled spaces between adjacent shattered glass pieces; and filling the spaces between the adjacent shattered glass pieces with grout to complete a mosaic look.

2. The method of claim 1 wherein the spacing between some of the shattered glass pieces is adjusted by manual movement of some individual pieces before the liquid adhesive solidifies.

3. The method of claim 1 wherein the striking is on an edge of the glass pane.

4. The method of claim 3 wherein a single striking of the pane at one edge position shatters substantially the entire pane.

5. The method of claim 3 wherein plural striking is used for substantially complete shattering across the pane.

6. The method of claim 3 wherein the spacing between some of the shattered glass pieces is adjusted by manual movement of some individual pieces before the liquid adhesive solidifies.

7. The method of claim 1 comprising the further step of applying a layer of insulating material at the back surface of the planar main member, whereby the decorative work of art is an insulating screen for removable covering of openings through which energy losses are otherwise typical.

8. The method of claim 7 wherein a lower support member is positioned along the lower edge of the frame and planar main member such that the layer of insulating material projects no further rearwardly than a back surface of the lower support member.

9. The method of claim 1 comprising the further step of applying a gasket strip at the back surface of the planar main member along the edges thereof, such gasket strip being configured to facilitate surface-conforming contact of the decorative work of art about an opening through which energy losses are otherwise typical.

10. The method of claim 9 comprising the further step of applying a layer of insulating material at the back surface of the planar main member, whereby the decorative work of art is an insulating screen for removable covering of openings through which energy losses are otherwise typical.

* * * * *